US005621705A

United States Patent [19]

Quine

[11] Patent Number: 5,621,705

[45] Date of Patent: Apr. 15, 1997

[54] PROGRAMMABLE TIMING UNIT FOR GENERATING MULTIPLE COHERENT TIMING SIGNALS

[75] Inventor: Richard W. Quine, Denver, Colo.

[73] Assignee: Colorado Seminary, Denver, Colo.

[21] Appl. No.: 236,643

[22] Filed: May 2, 1994

[51] Int. Cl.[6] ..... G04F 8/00

[52] U.S. Cl. ..... 368/117; 368/120

[58] Field of Search ..... 368/117–120

[56] References Cited

U.S. PATENT DOCUMENTS

| | | | |
|---|---|---|---|
| 3,581,214 | 6/1969 | Seegmiller | 368/120 |
| 4,362,970 | 12/1982 | Grady | 307/141.4 |
| 4,458,165 | 7/1984 | Jackson . | |
| 4,468,624 | 8/1984 | Rehbein et al. | 368/120 |
| 4,564,953 | 1/1986 | Werking . | |
| 4,719,375 | 1/1988 | Martin . | |
| 4,827,155 | 5/1989 | Firebaugh | 307/141.4 |
| 4,841,500 | 6/1989 | Lee | 368/120 |
| 4,875,201 | 10/1989 | Dalzell | 368/120 |
| 4,912,433 | 3/1990 | Motegi et al. | 368/120 |
| 4,968,907 | 11/1990 | Pepper . | |
| 5,039,950 | 8/1991 | McDermott | 368/120 |
| 5,084,913 | 1/1992 | Kingston et al. . | |
| 5,349,612 | 9/1994 | Guo et al. | 368/120 |
| 5,430,598 | 6/1995 | Rodolfo et al. | 307/141 |

*Primary Examiner*—Bernard Roskoski

*Attorney, Agent, or Firm*—Dorr, Carson, Sloan & Birney, P.C.

[57] ABSTRACT

A programmable timing unit having a number of event markers circuits that receive a master clock signal and generate an output when a predetermined time occurs. Optionally, the event marker circuit can add an interpolated delay time to provide greater resolution than the master clock circuit. The output is programmably coupled to any of a number of function circuits. Each function circuit has a trigger input for receiving the event signal and output for providing the delayed output function.

16 Claims, 8 Drawing Sheets

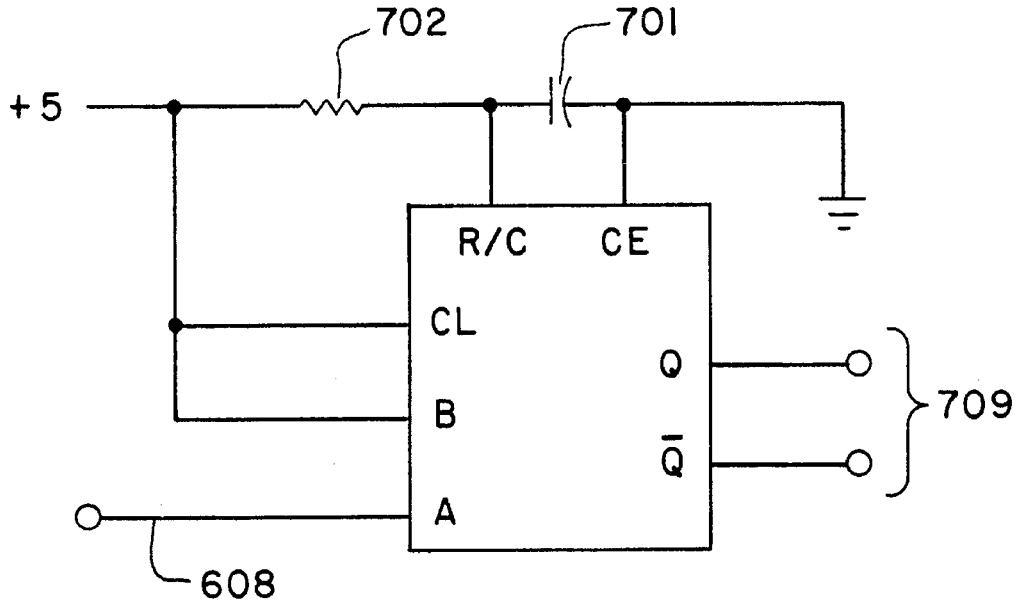
Fig. 7
Fig. 8
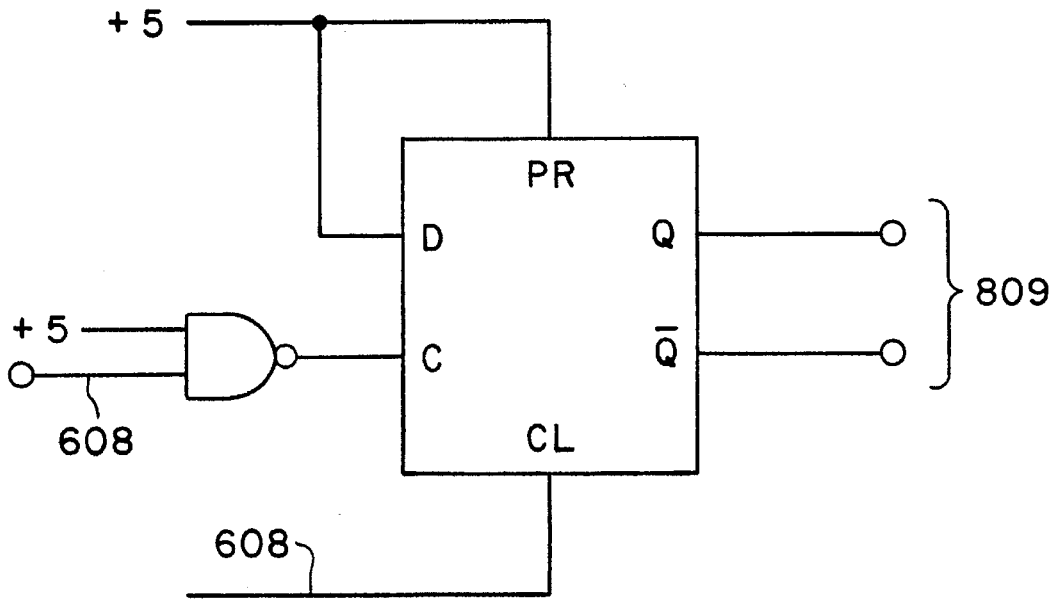

PROGRAMMABLE TIMING UNIT FOR GENERATING MULTIPLE COHERENT TIMING SIGNALS

BACKGROUND OF THE INVENTION

1. Field of the Invention

The present invention relates, in general, to timing apparatus and, more particularly, to a programmable timing apparatus for providing a number of precisely synchronized timing signals.

2. Statement of the Problem

Programmable timing units, also called digital delay generators, find many uses where it is desired to produce a number of signals at precise time intervals. For example, these devices are used for timing lasers, conducting electronics and materials research experiments, and other applications requiring very precise timing.

Typically, digital delay generators produce delay intervals from zero to many seconds with resolution on the order of one part in $10^{-8}$ and increment intervals as small as a few nanoseconds (one nanosecond or "ns" is $10^{-9}$ second). Conventional methods for generating timing signals having this level of resolution use an electronic timing oscillator directly controlled by a quartz crystal. Such an oscillator can operate at a frequency from 10 kilohertz (KHz) to several 100 megahertz (MHz). The frequency is determined primarily by the physical dimensions of the crystal.

A common variation in this conventional technique uses a timing oscillator that is controlled indirectly by a crystal oscillator using a phase-locked loop. The timing oscillator does not have to operate at the same frequency as the crystal oscillator in a phase-locked loop circuit, and accordingly, a wider choice of crystal oscillators is possible. The timing interval of the delay in both cases is generally determined by counting cycles of the timing oscillator.

In practical timing digital delay generators, the frequency of the timing oscillator is usually not much greater than 100 MHz. This is because readily available integrated circuits that are required to count the timing oscillator cycles do not operate well above 100 MHz. Since the smallest incremental interval determinable by counting cycles is one cycle, a 100-MHz oscillator will provide incremental intervals of 10 ns which is the period of a 100-MHz signal.

Various systems have been used to generate a sequence of timing signals of variable signal-to-signal interval by programming digital counters to produce the timing signals at predetermined counts of a clock. Tapped delay lines have also been used to delay the signals relative to the start of a timing sequence. The timing signal interval resolution in such systems has been limited by the clock resolution.

One timing signal generator is disclosed in U.S. Pat. No. 4,231,104 entitled "Generating Timing Signals" issued to St. Claire. This system uses a programmable counter in combination with a tapped delay line to produce a chain of pulses that are asynchronous with (i.e., not an integer multiple of) the clock period. The accuracy of such systems, however, is dependent on the accuracy of the tapped delay lines used. That is, a higher-resolution delay line would have a correspondingly smaller range of settings to which the timing signal can be set. Also, depending on the number of delay taps, it may be difficult to obtain certain timing signal period settings.

One way to alleviate these shortcomings is to use a higher-frequency clock. However, as discussed above, counters suitable for use at such high clock frequencies are complex and costly to fabricate. Also, the distribution of high-frequency clock signals throughout a timing system requires an expensive and complex high bandwidth transmission system. For this reason, it is desirable to distribute a lower-frequency clock throughout the system and remote portions of the timing unit. It is desirable to use system clocks with speeds less than 100 MHz.

Another problem of existing timing units is that they provide few delayed outputs. Typically 2 to 4 outputs are provided where each of the delays is synchronized either to a single clock or to one of the other delayed outputs. Hence, a user is very limited in his ability to configure the delay of the timing unit to provide a timing signal precisely when it is desired relative to any of the other delayed outputs. The limited number of outputs requires multiple timing units to be coupled together in series when more delayed output signals are required. This increases expense and complexity of the system as well as leading to inaccuracies caused by the connections between the timing units themselves.

There is a demand for timing units that have great accuracy and precision in the range of one nanosecond. However, existing timing units are relatively inaccurate in the range of one nanosecond. Even timing units or programmable delay lines that are specified with one-nanosecond resolution are accurate only plus or minus one nanosecond, or 100% error. Also, conventional timing units that offer nanosecond resolution can do so only through carefully constructed hardwired circuits, which makes them more difficult to configure to meet particular needs of the user.

One programmable timing unit is shown in U.S. Pat. No. 4,458,165 issued to Jackson on Jul. 3, 1984. This timing apparatus uses a pair of multiplexers and a fixed value delay device between the multiplexers in a negative feedback path. By selecting the signal path using the multiplexers, a limited number of different delay durations are provided between the input and output terminals. This method results in a programmable delay line, but only provides one output and a limited number of delay times.

U.S. Pat. No. 4,564,953 issued to Werking on Jan. 14, 1986, uses a high-speed (500-MHz) clock that is coupled to a two-stage counter. A delay is created by varying the modulus of the counter. The period resolution is limited to the resolution of the high-frequency clock, however.

U.S. Pat. No. 4,719,375 issued to Martin on Jan. 12, 1988, shows a digital delay timer that uses a series of three programmable delays to interpolate a delay between clock pulses of a system clock. The system, however, offers high precision for only a single delay interval and must be fine-tuned to produce other delays. No means is provided for easily switching between delay intervals. Moreover, although the system provides a delayed output, there is no way to programmably couple the delayed output to desired circuitry without using additional switching apparatus.

U.S. Pat. No. 4,968,907 issued to Pepper on Nov. 6, 1990, discloses a digital delay generator that uses an analog ramp method of timing and is susceptible to long-term temperature drifts associated with analog circuity. Analog circuitry also makes it more difficult to program the delay generator by using available digital microprocessors.

Accordingly, there remains a need for a programmable timing unit with great flexibility allowing the user to configure the delay interval over a wide range of times with great precision. A need also exists for a timing unit that can provide a number of delayed output signals where each delayed output signal occurs at a precise time after a triggering event or at a precise time with respect to a previous delayed output signal. Further, a need exists for a timing unit that uses a relatively low-speed clock and provides higher resolution than that clock without sacrificing accuracy in the timing interval.

Solution to the Problem

The present invention provides a solution to the above-mentioned problems by providing a programmable timing unit using a single relatively low frequency system clock to generate a number of timing signals that are synchronized with each other. Each of the number of timing circuits can be programmed to trigger anywhere along a time line defined by the low-frequency system clock. The programmable timing circuits are able to interpolate between clock pulses once they are triggered.

The outputs of the timing circuits are programmably coupled to any of the number of function circuits. The timing unit output signals are generated by the function circuits. Errors and inaccuracies caused by interconnections are minimized by positioning components near each other. Fixed time delays introduced by the distance between components are calibrated out. Because both the timing circuits and the matrix circuits are programmable, any number of timing outputs can be provided. Each timing output can be connected at the desired time to a desired function circuit.

SUMMARY OF THE INVENTION

The present invention provides a programmable timing unit having a number of event marker circuits. Each event marker circuit has a clock port for receiving a master clock signal. Event marker circuits include a means for detecting a predetermined time from the clock signal and generating an output when that predetermined time occurs. The output can be used directly as an event signal, in which case the resolution of the timing circuit is limited by the resolution of the master clock signal. Alternatively, the event marker circuit can add an interpolated delay time to the output of the means for detecting to form an event marker signal with greater resolution than the master clock circuit.

The timing unit further includes a means for programmably connecting each of the number of event marker circuits to a particular function circuit. Each function circuit has a trigger input for receiving the event signal and an output for providing the delayed output function. The means for programmably connecting and the programmable timing circuits can be programmed before a timing sequence has begun so that the timing unit itself maintains all control functions during the timing sequence, thereby maintaining precision and accuracy throughout the timing sequence.

BRIEF DESCRIPTION OF THE DRAWINGS

FIG. 7 illustrates a first type of function circuit useful in the present invention;

FIG. 8 illustrates a second type of function circuit useful in the practice of the present invention.

DETAILED DESCRIPTION OF THE DRAWINGS

1. Overview

Figure 1:
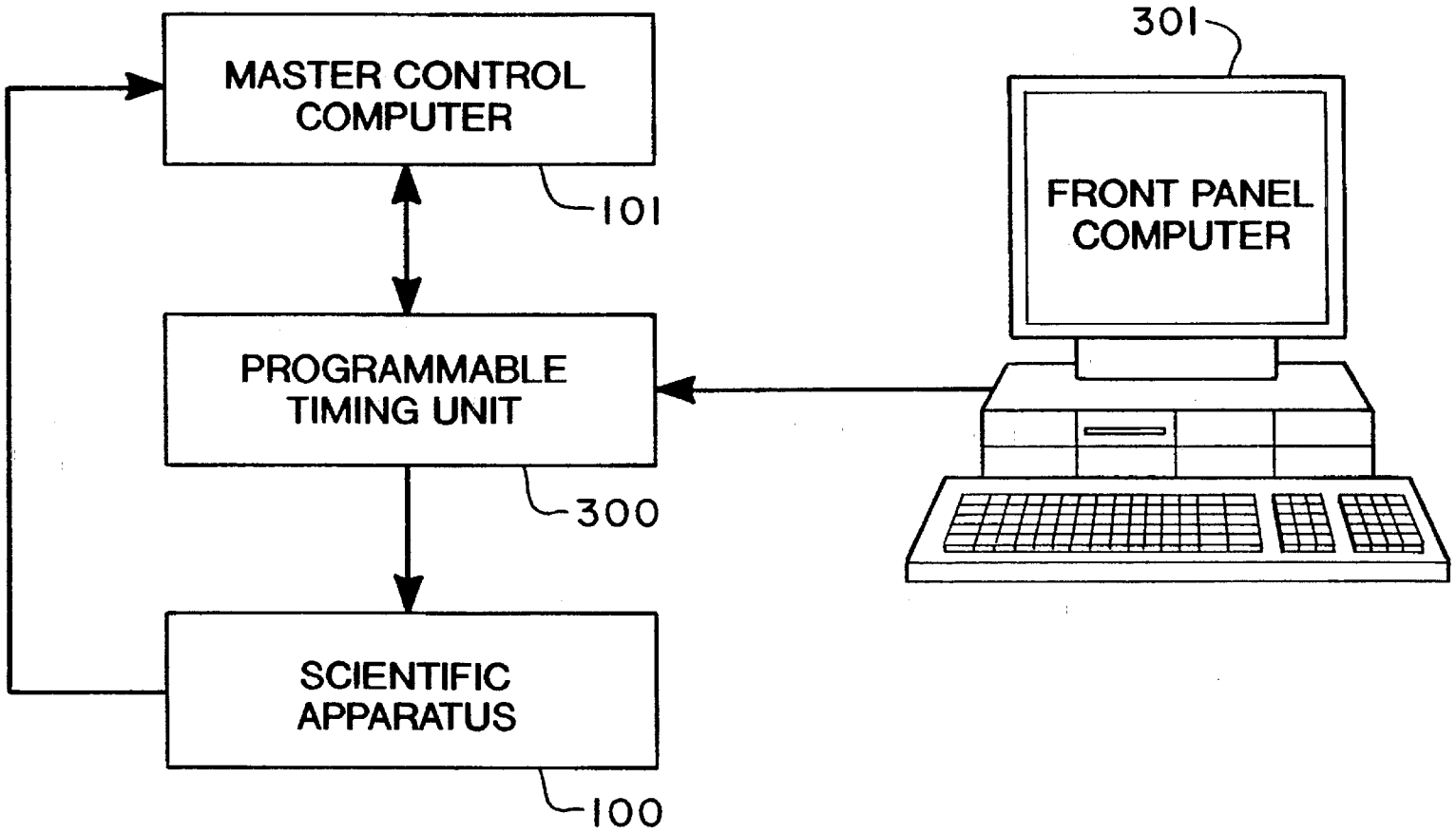
FIG. 1 shows in schematic form a system using the programmable timing unit in accordance with the present invention.

FIG. 1 shows a high-level schematic diagram of an experimental system using a programmable timing unit 300 in accordance with the present invention. The system of FIG. 1 is used for controlling a scientific experiment or apparatus 100 that requires a number of events to occur at precisely controlled times with a resolution of one nanosecond. The experimental system shown in FIG. 1 is exemplary. However, it should be understood that programmable timing unit 300 is useful in a wide variety of applications. The system shown in FIG. 1 is illustrative only and is not considered a limitation on the present invention.

Master control computer 101 serves to collect data from scientific apparatus 100 during the experiment, and to control the beginning and ending of the experiment. Master control computer 101 also accepts data from front panel computer 301 and stores this front panel data with the results provided by apparatus 100. Front panel computer 301 is preferably a personal computer that provides a user interface to programmable timing unit 300.

By embodying the interface in a separate computer 301, the user interface can be located physically away from programmable timing unit 300. This allows programmable timing unit 300 to be smaller and eliminates delays and inaccuracies caused by noise and the presence of circuitry of the front panel computer 301. Also, this allows the front panel computer 301 to be larger and more complex to provide a more "user friendly" interface that is easily programmed to meet the needs of the individual user.

In operation, a front panel computer is used to collect the programming instructions for programmable timing unit 300 from a user. These instructions will include 1) precise timing instructions indicating when programmable timing unit 300 is to produce outputs and 2) configuration data that instructs programmable timing unit 300 which type of output to produce at each programmed time.

Once front panel computer 301 has collected the configuration data, it is downloaded to programmable timing unit 300 before the timing sequence has begun. This allows relatively low speed data transfer between front panel computer 301 and programmable timing unit 300 so that the data transfer can be accomplished with conventional circuitry. Programmable timing unit 300 provides a number of precisely synchronized timing signals to a scientific apparatus 100. As discussed in greater detailed hereinafter, the timing signals can have a variety of characteristics such as a one-shot impulse, a change in a binary value, or simultaneous presentation of a plurality of binary signals.

Figure 2:
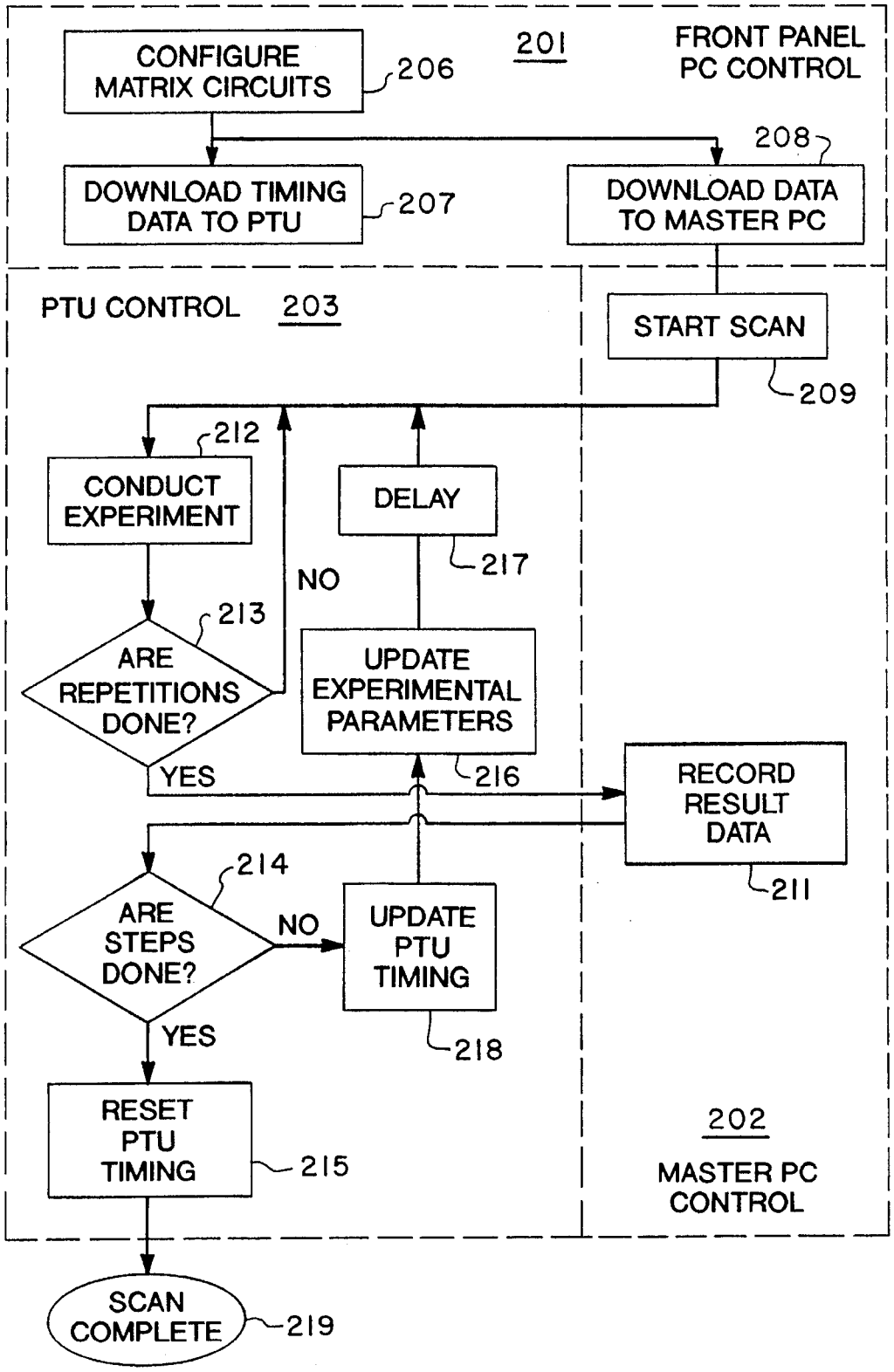
FIG. 2 illustrates a flow diagram of the control functions performed in the system shown in FIG. 1.

As seen in FIG. 2, the front panel computer 301, master control computer 101, and programmable timing unit 300 cooperate to control various events and functions. The functions controlled by the front panel computer 301 are indicated generally in the dashed box 201. Similarly, the functions under the control of master control computer 101 are shown in dashed box 202, while the functions controlled by the programmable timing unit 300 are shown in dashed box 203.

The functions under the control of front panel computer 301 include configuring the matrix circuits (shown in FIG. 3) of programmable timing unit 300 in step 206. In step 206, front panel computer 301 determines from the user which types of output functions should be generated at particular times in the timing sequence. Once determined, the front panel computer translates this information into a set of "configuration data" used to program matrix circuits and event markers 302 and 303 (shown in FIG. 3). The programmed matrix circuits 303 determine which of the number of programmed event marker circuits 302 should be connected to which of a number of function circuits 304 (shown in FIG. 3). Front panel computer 301 also obtains raw timing information from the user in step 206.

In steps 207 and 208, the front panel computer downloads the timing and configuration data to programmable timing unit 300 and to master control computer 101. Downloading step 207 serves to program programmable timing unit 300 so that each of a number of timing circuits described hereinafter is triggered at the desired time. Front panel computer 301 translates the desired times and matrix configurations inputed by the user into instructions or data that can be understood by programmable timing unit 300.

Downloading step 208 serves to store the timing information, and optionally the configuration information, provided by the user in master computer 101 as well as indicate that programmable timing unit 300 is programmed and ready to perform. Front panel computer 301 passes control to master control computer 101, which initiates the timing sequence or "scan" in step 209. Start scan 209 passes control of the timing sequence to programmable timing unit 300, although it should be noted that the master computer retains control over recording results data in later step 211.

The primary control function of the programmable timing unit 300 is to generate a series of synchronized timing signals in step 212. Step 212 may include generation of any number of timing signals that are necessary due to the great flexibility of programmable timing unit 300 of the present invention. In a preferred embodiment, up to 24 timing signals can be created during step 212 where each timing signal can be placed with one-nanosecond resolution anywhere in the timing sequence.

Although the primary function of programmable timing unit 300 is to control the experiment during step 212, other control functions can easily be integrated into timing unit 300. For example, in a particular embodiment the timing sequence of events performed in steps 212 needs to be repeated a number of times. Programmable timing unit 300 can be programmed to repeat those steps a predetermined number of times. In step 213 programmable timing unit 300 checks to see whether a pre-programmed number of repetitions have been completed, and if not, the experiment is conducted again.

Once the pre-programmed number of repetitions is completed, the master control computer stores the results data in step 211, and programmable timing unit 300 checks to see whether all of a preprogrammed number of steps have been performed in step 214. Each "step" of an experiment includes conducting the experiment for the pre-programmed number of repetitions and might require modification of some of the timing signals in programmable timing unit 300 and some experimental parameters in step 216.

In the preferred embodiment, programmable timing unit 300 includes programmable control circuitry (shown in FIG. 3) that allows the timing signals to be updated in step 218 without reference to front panel computer 301 during operation. After the timing signals are updated, the particular implementation shown in FIG. 2 returns to step 212.

Once the experiment 212 is repeated for the pre-programmed number of times and the programmed stepping sequence is complete in step 214, programmable timing unit 300 resets the timing signals in step 215. Step 215 essentially resets the timing signals to their state before the experiment was conducted in the initial pass through step 212. After reset step 215, programmable timing unit 300 has completed the scan as indicated in step 219 and control returns to front panel computer 301. At this stage, the experiment, including the programmed repetitions and step sequence, can be repeated, or new timing signals and configuration data can be entered into front panel computer 301 by a user.

During all of the steps 212 through 218 that are under control of the programmable timing unit, master control computer 101 (shown in FIG. 1) retains control over the data taking and recording functions by monitoring apparatus 100. The data recording step 211 preferably occurs independently of programmable timing unit 300 so that neither the experiment nor the data recording steps are slowed due to communication between programmable timing unit 300 and master control computer 101.

2. Programmable Timing Unit Architecture

Figure 3:
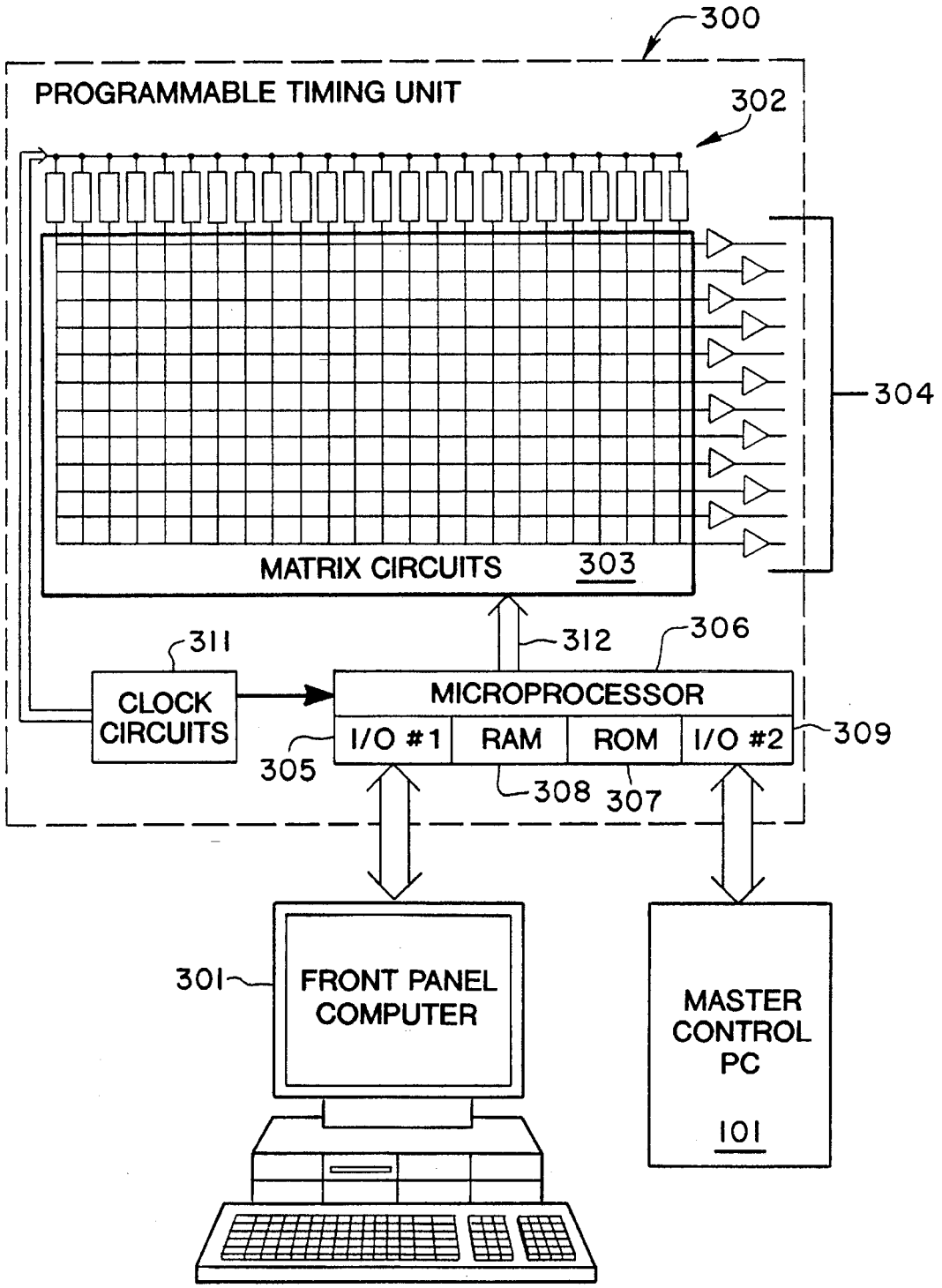
FIG. 3 illustrates a schematic diagram of the programmable timing unit organization in accordance with the present invention.

FIG. 3 illustrates in schematic form the organization and architecture of programmable timing unit 300 in accordance with the present invention. Programmable timing unit 300 includes a number of event marker circuits 302 that are coupled to the clock circuits 311 and provide an output that is coupled to matrix circuits 303. In the particular example of FIG. 3, twenty-four event marker circuits 302 are shown. However, it should be understood any number of event marker circuits can be included in a programmable timing unit 300 in accordance with the present invention. However, the complexity of matrix circuits 303 increases as the number of event marker circuits 302 increases.

Matrix circuits 303 couple selected outputs of one or more event marker circuits 302 to one or more selected function circuits 304. Function circuits 304 each have a "trigger input" coupled to matrix circuit 303 and an output that constitutes a precise timing signal. Function circuits 304 respond to a signal on their trigger input and produce an output signal or waveform that has characteristics determined by the details of function circuit 304. In essence, function circuits 304 are simple waveform generator circuits that give extensive control and functionality to the output of the programmable timing unit 300 of the present invention. Several different types of function circuits 304 are possible, a few of which are described in greater detail hereinafter.

Clock circuits 311 provide a master clock signal that is distributed to each of the event marker circuits 302. Preferably, the master clock signal is a digital word that is sixteen bits wide. Alternatively, a more conventional oscillating clock signal can be provided by clock circuits 311. The advantage of a parallel digital clock signal is that a parallel counter circuit does not have to be duplicated on each event marker 302 card.

Preferably, clock circuits 311 also provide a system clock for microprocessor 306. This system clock is a conventional system clock performing substantially the same function as any system clock in any microprocessor or personal computer. For example, a programmable timing unit 300 in accordance with the present invention has been made with a 5-MHz system clock signal generated by clock circuits 311.

Microprocessor 306 is associated with a read only memory (ROM) 307, random access memory (RAM) 308, a first input/output (I/O #1) port 305, and a second I/O port 309. I/O ports 305 and 309, RAM 308, and ROM 307 may be provided on a single integrated circuit with microprocessor 306, or in separate devices. First I/O port 305 serves as an interface between programmable timing unit 300 and master control computer 101. Second I/O port 309 serves as an interface between programmable timing unit 300 and front panel computer 301. The other functions performed by ROM 307, RAM 308, and I/O ports 305 and 309 are described in greater detail hereinafter in regard to operation of programmable timing unit 300.

In the preferred embodiment, programmable timing unit 300 is configured as a mother board that houses microprocessor 306 and the associated ROM, RAM, and I/O circuits as well as clock circuits 311. The event marker circuits 302 are each provided as separate daughter boards that are plugged into sockets provided on the mother board. Function circuits 304 are formed as separate daughter boards and plugged into sockets provided on the mother board. Matrix circuits 303 are formed on the daughter boards with the function circuits 304, but may be formed as separate boards or on the mother board.

Front panel computer 301 may be located at a distance from both the mother board and the daughter boards. Front panel computer 301 communicates with the programmable timing unit 300 via I/O port 309. Once front panel computer 301 has compiled instructions, as described before, microprocessor 306 receives the instructions from I/O port 309 and stores the instructions in RAM 308. ROM 307, which is preferably an erasable programmable ROM, is programmed before the programmable timing unit is used with basic data and instructions to start up and support functioning of microprocessor 306.

In operation, microprocessor 306 transfers the timing signals to local memories or registers (shown in FIG. 5) in each of event marker circuits 302. Once the timing signals are transferred to event marker circuits 302, they respond to the master clock signal autonomously without additional control by microprocessor 306. Also, microprocessor 306 transfers configuration data to matrix circuits 303 before the programmable timing unit 300 is used. Matrix circuits 303 include a memory or register circuit (shown in FIG. 6) for storing the configuration instructions from microprocessor 306 during operation and so require no further control from microprocessor 306.

In summary, clock circuits 311 provide a master clock signal that is shared by each of a large number of event marker circuits 302. A microprocessor stores timing instructions or timing signals for the event marker circuits 302 and programs the event marker circuits prior to operation. Similarly, microprocessor 306 stores configuration data and programs matrix circuits 303 prior to operation. In this manner, each of the plurality of event marker circuits 302 is programmed individually to respond at a predetermined time in response to the master clock signal and the event marker signal is programmably coupled to one of a number of function circuits 304 that generate the actual output of programmable timing unit 300. Each of these subsystems is described in greater detail hereinafter.

3. Clock Circuits

Figure 4:
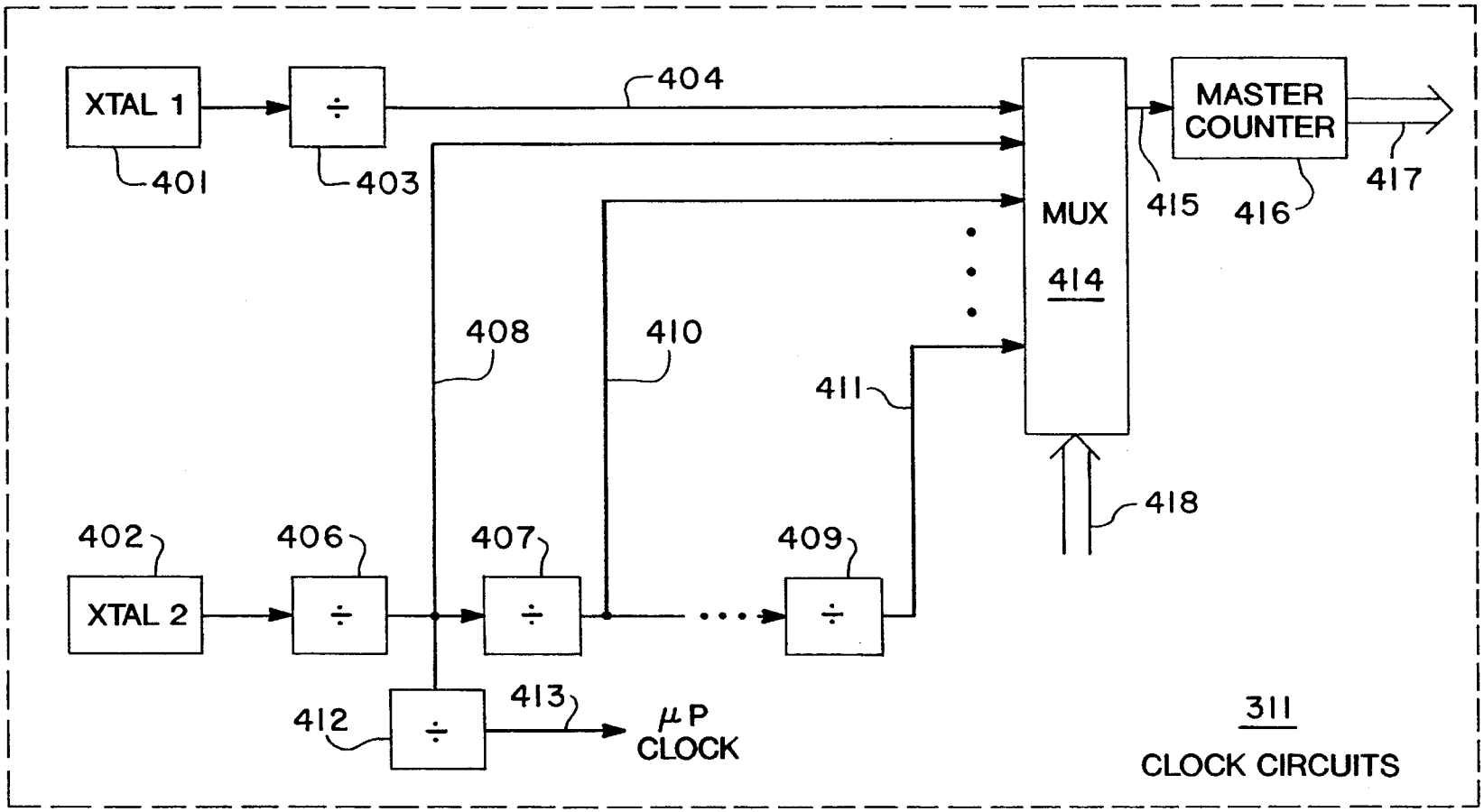
FIG. 4 shows a schematic diagram of clock circuitry used in the programmable timing unit of FIG. 3.

FIG. 4 illustrates in schematic form an exemplary clock circuit 311 useful in the practice of the present invention. It should be understood that a great deal of flexibility is available in the actual clock circuit used, and a great number of clock circuits are known. Accordingly, the clock circuit 311 shown and described in reference to FIG. 4 is but one of many clock circuits that could be used in the practice of the present invention.

Clock circuit 311 preferably includes at least one crystal oscillator. In the particular embodiment shown in FIG. 4, two crystal oscillators, 401 and 402, are used. First crystal oscillator 401 provides a first reference signal that is used in the high-resolution mode of operation. In a specific example, crystal oscillator 401 oscillates at 62.5 MHz and is used in a "one-nanosecond mode" of operation when one-nanosecond precision is desired.

The output of crystal oscillator 401 is coupled to a divider or prescaler 403. Divider circuit 403 divides the frequency of the first reference signal provided by crystal oscillator 401 by an integer value to provide a first divided reference signal on output line 404. In the preferred embodiment, divider circuit 403 divides by the integer two to produce a divided reference signal having a 32.25-MHz frequency on line 404. The period of the divided reference signal on line 404 is 32 nanoseconds.

Second crystal oscillator 402 operates in a manner similar to that of first crystal oscillator 401 but produces a second reference frequency for use in less precise modes of operation. In a particular example, crystal oscillator 402 operates at 20 MHz. Divider circuits 406, 407, and 409 are connected in series to provide a series of divided reference signals on lines 408, 410, and 411. For example, divider circuit 406 can divide the reference frequency from crystal oscillator 402 by an integer two to produce a divided reference signal having a frequency of 10 MHz on line 408. The period of a 10-MHz signal is 0.1 microsecond.

Divider circuit 407 further divides the frequency by an integer 10 to produce a divided reference signal having a 1-MHz frequency. Likewise, divider circuit 409 will divide by some selected integer value to produce a divided reference signal on line 411. In this manner any number of divided reference signals can be provided to multiplexer 414 to provide a variety of clock signals of various frequencies and periods.

It should be understood that the particular division steps performed by divider circuits 403, 406, 407, and 409 are completely discretionary and are selected to provide convenient reference signals to multiplexer 414. The number of reference frequencies that are provided to multiplexer 414 determines the number of operating ranges in which the programmable timing unit in accordance with the present invention can be used. It is contemplated that some applications for programmable timing unit 300 will require only one reference signal, which will eliminate a need for some or all of the divider circuits shown in FIG. 4.

Multiplexer 414 (MUX in FIG. 4) is used to select among the several divided reference frequencies on lines 404, 408, 410, and 411. Preferably, multiplexer 414 is a one-of-eight multiplexer that selects one of the input lines and couples it to multiplexer output line 415. Multiplexer 414 is controlled by a digital control word provided on input port 418. Preferably, the digital control word would be stored in a register or memory circuit (not shown) during operation. The digital control word would be provided to the memory circuit by microprocessor 306 (shown in FIG. 3) before programmable timing unit 300 is operated.

Output 415 of multiplexer 414 is coupled to the input of master counter 416. Preferably, master counter 416 is a sixteen-bit binary counter that provides a sixteen-bit output word on master clock bus 417. The sixteen-bit output word is the master clock signal that is coupled to event marker circuits 302 shown FIG. 3. Master counter 416 counts each pulse of the divided reference frequency selected by multiplexer 414. In this manner master counter 416 provides a master clock signal on bus 417 that is proportional to the frequency of the selected divided reference signal.

Optionally, the clock circuit can provide a system clock for microprocessor 306 (shown in FIG. 3). This is done by dividing the reference signal from either crystal oscillator 401 or crystal oscillator 402 to provide a convenient system clock signal. As shown in FIG. 4, the divider circuit 412 further divides the divided reference signal provided from divider circuit 406 to provide a system clock on line 413. In a particular example, divider circuit 412 is a divide-by-two circuit that produces a system clock having a 5-MHz frequency on line 413.

It should be understood that a variety of clock circuits are known and can be used in conjunction with the present invention. For example, the plurality of divider circuits shown in FIG. 4 can be replaced with one or more phase-locked loops that could be individually programmed to provide the desired reference frequencies. If one reference frequency were used or a single phase-locked loop circuit were used, multiplexer 414 and its associated circuitry would not be necessary. Master counter 416 must be capable of accurately responding to the highest-frequency reference signal that is provided by clock circuits 311. Alternatively, the reference signal can be provided directly to the event marker circuits with a counter located on each event marker circuit. However, it is believed that locating master counter 416 within clock circuit 311 and providing the digital word on line 417 provides the greatest accuracy and precision with minimal complexity.

4. Event Marker Circuits

Figure 5:
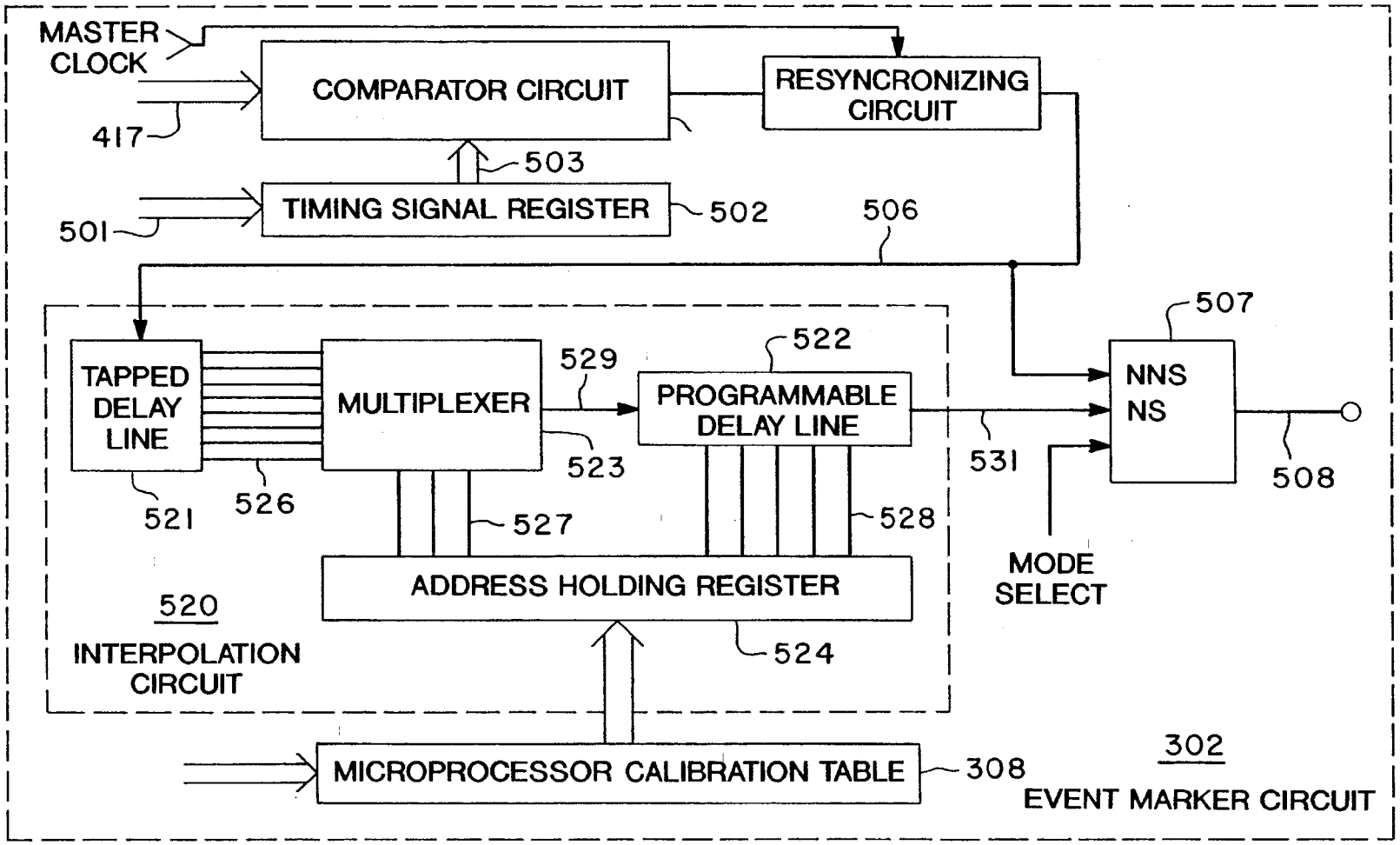
FIG. 5 illustrates in schematic form circuit details of event marker circuits shown in the programmable timing unit of FIG. 3.

A simplified schematic diagram of event marker circuits 302 is shown in FIG. 5. Event marker circuits monitor the master clock signal and generate an "event marker signal" at a programmed time in reference to the master clock signal. Event marker circuits 302 preferably have two modes of operation. First, when the resolution required of the delayed event marker signal is equal to the resolution of the master clock signal on line 417, the event marker signal can be triggered directly from the master clock signal. This is referred to as a "low-resolution mode." In a second mode of operation the resolution of the event marker signal is greater than the period of master clock signal line 417. This second mode is alternatively referred to as the "high-precision mode" or the "one-nanosecond mode." Mode selector circuit 507 serves to select the proper output depending on the mode of operation.

Mode 1:

Low Resolution

Event marker circuit 302 is programmed via an input from microprocessor 306 (shown in FIG. 3) on input port 501. Input port 501 is coupled to receive data from front panel computer 301 shown in FIG. 3. A timing signal register 502 is located in the event marker circuit and is used to store the timing signal provided by microprocessor 306. The timing signal stored in register 502 is preferably a digital word of the same width as that used for the master clock signal 417.

The timing signal register is coupled to comparator circuit 504 by data bus 503. Comparator circuit 504 is a conventional digital comparator that generates an output signal when the digital word on input port 417 is equivalent to the digital word provided by timing signal register 502. Desirably, the output signal from comparator 504 is passed through resynchronizing circuit 505, which synchronizes the output pulse with the master clock signal. Hence, the output signal on line 506 represents a precise time in the time sequence defined by the master clock signal on line 417.

In the lower-resolution mode, the signal on line 506 is coupled through mode selector 507 to output line 508 and provides the event marker signal. Mode selector 507 is a multiplexer selection between low- and high-resolution outputs.

Mode 2:

High Resolution

In the second mode, interpolation circuit 520 is activated to add a precise delayed time that is less than the period of the master clock signal. Hence, all of the circuitry described above in reference to the low-resolution mode operates as described hereinbefore. In high-resolution mode, the signal on line 506 is further delayed by a precision delay defined by interpolation circuit 520. Mode selector circuit 507 serves to select the proper output depending on the mode of operation.

An important feature of interpolation circuit 520 is a first programmable delay 521 and second programmable delay 522 that are coupled in series so that their delays add. Programmable delay 521 is an M-bit programmable delay, meaning that M different delay times can be programmability selected. In a particular example, programmable delay 521 is an eight-bit programmable delay meaning that eight delay times in the range of one to about eight nanoseconds in addition to fixed delays are provided on output lines 526.

Multiplexer 523 serves to select one of the eight outputs 526 from programmable delay 521. Thus, multiplexer 523 works together with programmable delay 521 to provide a first delayed signal on line 529. Multiplexer 523 is controlled by three control bits on line 527 that are provided by an address holding register 524.

In a particular example, programmable delay line 521 is provided by a tapped delay line such as part number DDU7F, manufactured by Digital Delay Devices, Inc., which has a specified resolution of one nanosecond. However, because the delay line has only a specified accuracy of plus or minus 0.5 nanosecond, the actual delay time provided on each of output lines 526 must be empirically determined (e.g., measured with a high-frequency oscilloscope).

The first delayed signal on line 529 is then coupled to a second programmable delay 522. In the specific example, programmable delay 522 is an N-bit programmable delay that provides a single output on line 531. The magnitude of the delay provided by programmable delay 522 is controlled by data lines 528 from address holding register 524. The number of delays provided by programmable delay 522 is $2^N$.

An important feature of the present invention is that the number of total possible combinations of delays provided by the series combination of programmable delays 521 and 522 is greater than the number of delay times required to interpolate the master clock period into the desired precision. For example, in the preferred embodiment the master clock signal has a period of thirty-two nanoseconds. To provide one-nanosecond precision, interpolation circuit 520 must generate thirty-two interpolation delays that can be added to the signal on line 506 to provide the one-nanosecond resolution. However, although only thirty-two time delays are required by interpolation circuit 520, programmable delay 521 can produce eight distinct delay times and programmable delay line 522 can produce thirty-two distinct delay times. Thus, the total number of delay times provided by interpolation circuit 520 is (8×32) or 256 possible delays.

The precise delay time provided by programmable delay 521 by each control word on line 527 is determined. Likewise, the precise delay time provided by programmable delay 522 in response to each control word on line 528 is determined. A "calibration pairing" is determined by pairing an M-bit control word for programmable delay 521 with an N-bit control word for programmable delay 522. One calibration pairing is stored in calibration ROM table 308 for each desired delay time. The calibration pairing represents the pair of control words that drive series-coupled programmable delays 521 and 522 such that the cumulative delay time is more accurate than the accuracy of either programmable delay 521 or 522 alone. Each event marker circuit 302 is calibrated in this manner before use, and the calibration pairings are stored in the microprocessor calibration table in ROM 307 because the calibration pairings will not change, and so need not be programmed, each time event marker circuit 302 is used.

The microprocessor calibration table stored in ROM 307 contains one calibration pairing for each delay time that is desired to be produced by interpolation circuit 520. In the specific example, thirty-two delay times are desired so the microprocessor calibration table would contain thirty-two calibration pairings for each event marker circuit 302. When the timing data is downloaded to programmable timing unit 300 during step 207, one calibration pairing is accessed in calibration table from ROM 307 when programmable timing unit 300 operates in the high-resolution mode. The accessed calibration pairing is then transferred to and held in address holding register 524. Lines 527 and 528, which are the outputs of address holding register 524, then drive multiplexer 523 and programmable delay 522 to provide a precision delay time from line 506 to line 531 in FIG. 5.

In summary, event marker circuit 302 is programmed with timing data and programmed to operate in either a high-resolution or a low resolution mode. In low-resolution, the timing data is compared to the master clock signal and an event marker signal is generated when the clock signal is equal to the timing data. In high-resolution mode, an accurate and precise delay time is added by interpolation circuit 520. Interpolation circuit 520 is formed by a first programmable delay 521 having M possible delays coupled in series with a second programmable delay line 522 N possible delays. Microprocessor calibration table stored in ROM 307 preferably contains a number of calibration pairings that is less than the product of M and N (M×N). Because the number of possible pairings M×N is greater than the number of required pairings, calibration pairings with precise time delays are provided that have a greater accuracy than either of the programmable delays 521 or 521 alone. In this manner, each event marker circuit 302 produces an output, which is preferably a binary transition, on output line 508 precisely at a programmed time.

5. Matrix Circuits

Figure 6:
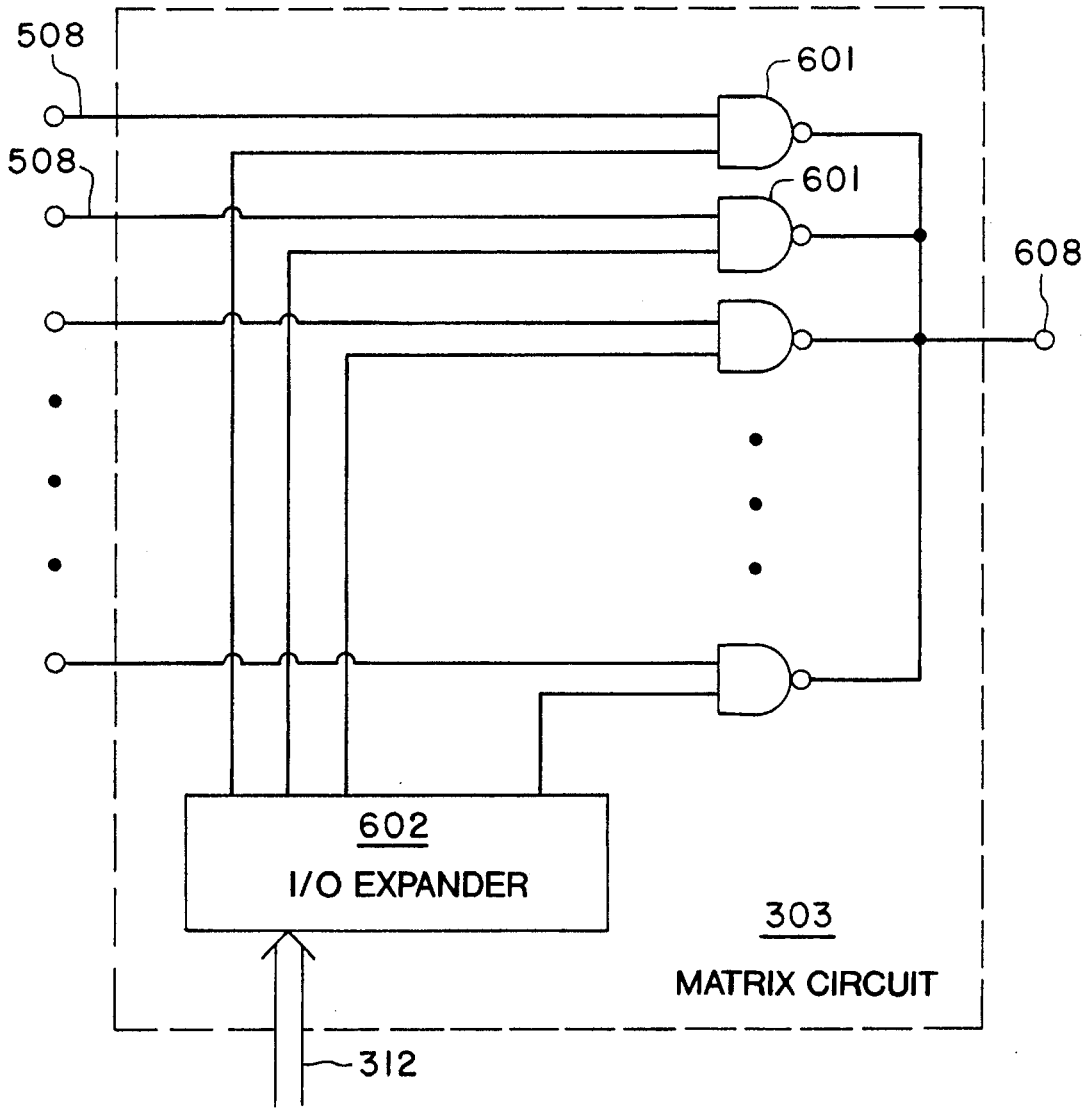
FIG. 6 shows circuit details of the matrix circuit shown in the programmable timing unit of FIG. 3.

FIG. 6 illustrates a simplified schematic of the matrix circuit 303 in accordance with the present invention. Essentially, each matrix circuit serves to couple at least one event marker circuit 302 to at least one of the function circuits 304. This allows the programmable timing unit 300 to be flexibly configured by simple software changes without requiring the hardwired reconfiguration of prior timing units. Each matrix circuit 303 comprises a plurality of gates 601. As shown in FIG. 6, gates 601 are preferably logic NAND gates each having two inputs and one output. Alternatively, gates 601 could be formed by a simple transistor or other logic arrangement known to be equivalent to a NAND gate. One of the inputs to each of the NAND gates 601 is coupled to the output 508 of an event marker circuit 302. The other input to gate 601 is coupled to register 602. Register 602 has an input port coupled to microprocessor 306 via data bus 312 (shown in FIG. 3). Register 602 serves as a local memory device for storing the configuration data from microprocessor 306. Preferably, register 602 is an input/output expander that is a register having a 4-bit input and a 16-bit output.

Using NAND gates for gates 601, a logic one on the control input provided from register 602 to the NAND gate allows the event marker signal on the input 508 associated with that gate 601 to pass from input 508 to output 608. The outputs of each of the NAND gates are hardwired "ORed" together as shown in FIG. 6. Thus, an event marker signal can pass from any input 508 to output 608 depending on the contents of register 602.

One matrix circuit 303 must be provided for each function circuit 304 (shown in FIG. 3). This is because the function circuit 304 has a trigger input that receives the signal from line 608 shown in FIG. 6. In this manner, any of the event marker signals on lines 508 that originate from event marker circuits 302 can be programmably coupled to a selected function circuit 304.

6. Function Circuits

Function circuits 304 (shown in FIG. 3) can have a wide variety of structures and functions. Their primary responsibility is to generate the final timing signal from programmable timing unit 300. The use of function circuits allows the timing signal to be tailored to the particular needs of a scientific apparatus 100 (shown in FIG. 1) or instrument that is controlled by programmable timing unit 300. Each function circuit has a trigger input coupled to the output 608 (shown in FIG. 6) of a matrix circuit 303. Because of the great simplicity of most function circuits 304 it is desirable to assemble programmable timing unit 300 so that several function circuits are located on a single card that is a daughter board.

FIG. 7 illustrates a useful function circuit for providing a "one-shot" output on differential output 709. One-shot circuits such as that shown in FIG. 7 are available from a variety of manufacturers for example, industry standard part #SN74123N. The pulse duration is determined by the value of capacitor 701 and resistor 702 as specified by the manufacturer of the one-shot circuit.

FIG. 8 shows a flip-flop circuit that outputs a binary change of state once triggered by a signal on line 608. The flip-flop can be reset by a second signal on line 608. The flip-flop circuit shown in FIG. 8 is a conventional DC flip-flop with D input coupled to $V_{CC}$. The C input is used to receive the event marker signal on line 608 while the outputs form a differential output 809 from programmable timing unit 300.

Figure 9:
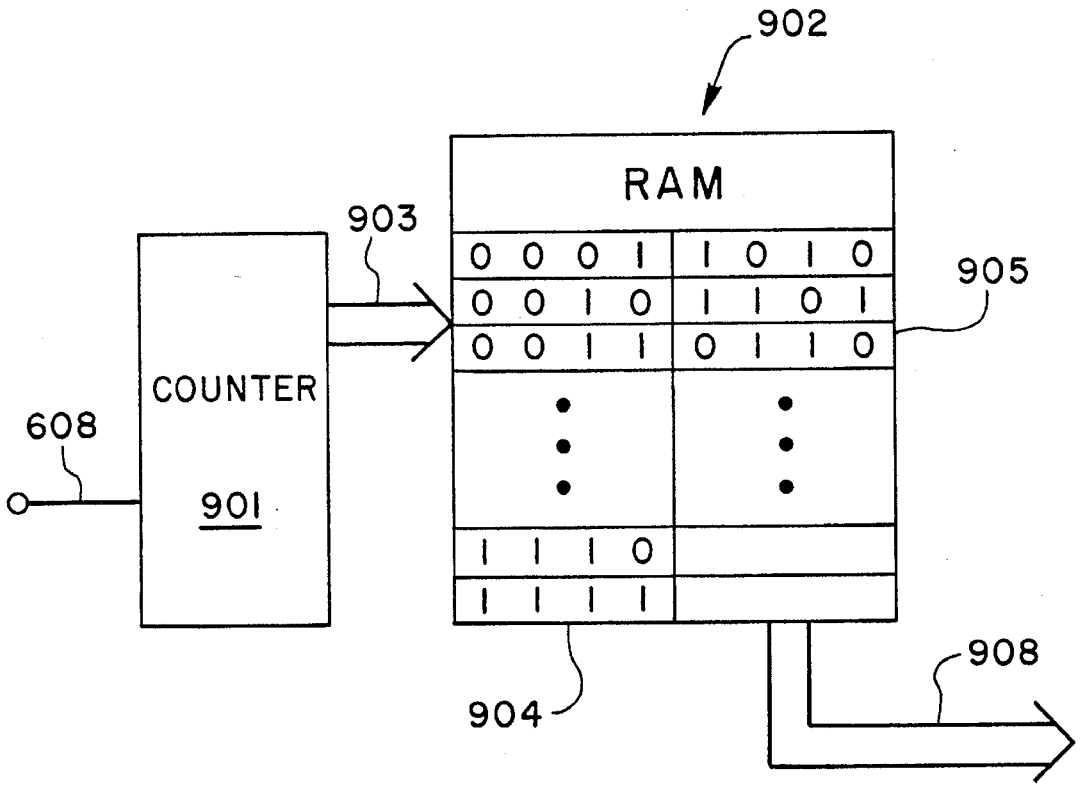
FIG. 9 illustrates a third type of function circuit useful in the programmable timing unit of FIG. 3.

FIG. 9 illustrates a random access memory (RAM) function circuit that is very useful in expanding the number of outputs provided at a single time marked by an event marker circuit. As do the other function circuits 304, the RAM function circuit shown in FIG. 9 receives a trigger input from the output of the matrix circuit on line 608. Line 608 is coupled to the input of counter 901, which is preferably an up/down binary counter. Counter 901 produces a multi-bit output on bus 903. In the preferred embodiment, the value of the multi-bit word on bus 903 increments one binary count each time an event marker signal is received on line 608.

RAM 902 contains an address section 904 and a data section 905. RAM 904 can have any convenient depth and width. That is to say, address section 904 can have any number of addresses and data portion 905 can store any number of binary bits at each address location. In the preferred embodiment, RAM 902 is a 16-address RAM that requires 4 address bits as shown in FIG. 9. Each address location in the preferred embodiment contains 4 binary bits. In operation, each time counter 901 increments, a new address is accessed via bus 903. Once an address is accessed, the contents of that address are presented on RAM output bus 908. Thus, each time an event marker signal is received on line 608, counter 901 increments, and 4 new data bits are presented on line 908. This allows 4 operations to be synchronously controlled from a single event marker signal and is quite useful when several devices must be coordinated.

It is to be expressly understood that the claimed invention is not to be limited to the description of the preferred embodiment but encompasses other modifications and alterations within the scope and spirit of the inventive concept. For example, any number of event marker circuits and function circuits may be provided in the programmable timing unit of the present invention. Also, a variety of timing circuits may be used to implement timing circuits 311. Although the preferred embodiment uses a microprocessor for control in the programmable timing unit, it is possible to use more complex dedicated control logic without deviating from the spirit of the present invention. Accordingly, these and other modifications of the present invention are within the scope and spirit of the present invention.

I claim:

1. A programmable timing unit comprising:

a plurality of event marker circuits, each event marker circuit having:

1) a clock port for receiving a clock signal, 2) means coupled to the clock port for detecting a predetermined time period from the clock signal, and 3) an output for providing an event signal when the predetermined time occurs;

a plurality of function circuits, each function circuit having a trigger input for receiving the event signal; and means for programmably connecting each of the function circuits to the output of at least one of the number of event marker circuits.

2. The programmable timing unit of claim 1 wherein the means for detecting a predetermined time of each of the number of event marker circuits further comprises:

a program input for receiving a timing value corresponding to the predetermined time;

means for storing the timing value; and means for generating the event signal when a value of the clock signal and the stored timing value are equal.

3. The programmable timing unit of claim 2 wherein the clock signal and the timing signal are formatted as digital words and the means for generating the event signal is a digital comparator.

4. A programmable timing unit comprising:

a plurality of event marker circuits, each event marker circuit having:

1) a clock port for receiving a clock signal, 2) means coupled to the clock port for detecting a predetermined time period from the clock signal, 3) an output for providing an event signal when the predetermined time occurs, 4) a first programmable delay having M possible delay times, an input coupled to the means for detecting a predetermined time, a control input for receiving a first delay control signal to select a desired delay time from the M possible delay times for the first programmable delay, and an output providing a delayed output signal, and 5) a second programmable delay having N possible delay times, a signal input for receiving the delayed output signal, a control input for receiving a second delay control signal to select a desired delay time from the N possible delay times for the second programmable delay, and an output providing the event signal;

a plurality of function circuits, each function circuit having a trigger input for receiving the event signal;

means for programmably connecting each of the function circuits to the output of at least one of the number of event marker circuits.

5. The programmable timing unit of claim 4 further comprising:

programmable control means having an input/output data port coupled to the event marker circuits and memory; and a number of calibration pairings stored in the memory for at least one event marker circuit, each calibration pairing including a first portion for providing the first delay control signal to the first programmable delay and a second portion for providing the second delay control signal to the second programmable delay, the number of calibration pairings being less than (M×N).

6. A programmable timing unit comprising:

a plurality of event marker circuits, each event marker circuit having: 1) a clock port for receiving a clock signal, 2) means coupled to the clock port for detecting a predetermined time period from the clock signal, 3) an output for providing an event signal when the predetermined time occurs, wherein the means for detecting a predetermined time of each of the number of event marker circuits further comprises: 1) a program input for receiving a timing value corresponding to the predetermined time, 2) means for storing the timing value, and 3) means for generating the event signal when a value of the clock signal and the stored timing value are equal;

a plurality of function circuits, each function circuit having a trigger input for receiving the event signal;

means for programmably connecting each of the function circuits to the output of at least one of the number of event marker circuits;

a microprocessor having an input/output port coupled to the means for programmably connecting, coupled to the program input of the event marker circuits, and coupled to receive instructions from a remote computer; and a memory for storing the timing signal in binary encoded format for each of the number of event marker circuits and for storing an interconnection program for the means for programmably connecting.

7. The programmable timing unit of claim 1 further comprising:

a clock circuit providing the clock signal to each of the event marker circuits.

8. The programmable timing unit of claim 1 wherein at least one of the plurality of function circuits further comprises a one-shot circuit that receives the event marker signal and generates an impulse output.

9. The programmable timing unit of claim 1 wherein at least one of the plurality of function circuits further comprises a flip-flop circuit having a flip-flop input coupled to receive the event marker signal and a flip-flop output, wherein the flip-flop circuit changes its output signal from a first steady state to a second steady state voltage in response to the event marker signal.

10. The programmable timing unit of claim 1 wherein at least one of the plurality of function circuits further comprises:

an addressable memory having an address port, a plurality of addresses, and an output port, wherein a predetermined output word is stored in each address and provided on the output port in response to an address instruction on the address port; and a counter having an output port coupled to the address port of the addressable memory and having an input coupled to receive the event marker signal, the counter responding to the event marker signal by providing an address word on the counter output port.

11. A programmable timing unit comprising:

a plurality of event marker circuits, each event marker circuit having:

1) a clock port for receiving a clock signal, 2) means coupled to the clock port for detecting a predetermined time period from the clock signal, and 3) an output for providing an event signal when the predetermined time occurs;

a plurality of function circuits, each function circuit having a trigger input for receiving the event signal; and means for programmably connecting each of the function circuits to the output of at least one of the number of event marker circuits, wherein the means for programably connecting further comprises a plurality of matrix circuits, each matrix circuit having:

a number of matrix circuit inputs, each matrix circuit input coupled to one output of an event marker circuit, one matrix circuit output, and a control input associated with each matrix circuit input so that a control signal applied to a particular control input causes the event signal to pass from the matrix circuit input associated with the particular control input to the matrix circuit output.

12. The programmable timing unit of claim 11 further comprising the number of NAND logic gates, each having a first input that forms one of the matrix circuit inputs and a second input that forms one of the control inputs and each having an output, each output of the number of NAND logic gates being coupled together to form the matrix circuit output.

13. The programmable timing unit of claim 12 further comprising:

means for storing a matrix circuit control signal, the means for storing having an output line coupled to each of the control inputs of the matrix circuit and having input port; and a microprocessor having input/output ports coupled to the means for storing and programmed to provide the matrix circuit control signal to the means for storing.

14. A method for providing a number of synchronized function signals comprising the steps of:

providing a master clock signal;

storing a timing value for each of a preselected number of event signals, wherein the preselected number of event signals is the same or less than the number of function signals;

comparing a value of the master clock signal to the timing values;

generating one of the preselected number of event signals whenever the value of the master clock signal matches one of the stored timing values;

programmably connecting the event signals to at least one function circuit; and generating one of the function signals using the at least one function circuit each time one of the number of event signals is connected to a function circuit;

selecting a first delay time from a first programmable delay circuit;

selecting a second delay time from a second programmable delay circuit;

delaying the event marker signal by a sum of the first and second selected delay times before generating the function signal.

15. The method of claim 14 wherein the step of programmably connecting further comprises:

downloading a matrix circuit control signal from a remote computer;

storing the downloaded matrix circuit control signal in a memory;

coupling the number of event signals through an array of NAND gates to the at least one function circuit;

coupling the matrix circuit control signal to the array of NAND gates to enable a portion of the array of NAND gates to pass the event signals to the at least one function circuit.

16. The method of claim 15 wherein the step of programmably connecting occurs before the steps of comparing and generating.

* * * * *